US005320234A

United States Patent [19]

Kamath

[11] Patent Number: 5,320,234

[45] Date of Patent: Jun. 14, 1994

[54] TAMPER-INDICATING PLASTIC CLOSURE WITH PILFER BAND HAVING STAGGERED SCORES

[75] Inventor: Ramesh Kamath, Indianapolis, Ind.

[73] Assignee: H-C Industries, Inc., Crawfordsville, Ind.

[21] Appl. No.: 958,014

[22] Filed: Oct. 7, 1992

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,305,516 | 12/1981 | Perne et al. | 215/252 |
| 4,394,918 | 7/1983 | Grussen | 215/243 |
| 4,418,828 | 12/1983 | Wilde et al. | 215/252 |
| 4,497,765 | 2/1985 | Wilde et al. . | |
| 4,520,939 | 6/1985 | Itsubo et al. | 215/252 |
| 4,565,295 | 1/1986 | Mori et al. | 215/252 |
| 4,573,601 | 3/1986 | Berglund . | |
| 4,588,100 | 5/1986 | Itsubo et al. | 215/252 |
| 4,664,279 | 5/1987 | Obrist et al. | 215/252 |
| 4,666,053 | 5/1987 | Corcoran et al. . | |
| 4,720,018 | 1/1988 | Schetzsle et al. | 215/252 |
| 4,784,280 | 11/1988 | Breuer et al. . | |
| 4,938,370 | 7/1990 | McBride . | |
| 4,978,017 | 12/1990 | McBride . | |
| 5,004,112 | 4/1991 | McBride . | |
| 5,056,675 | 10/1991 | Julian | 215/252 |
| 5,080,246 | 1/1992 | Hayes | 215/252 |

FOREIGN PATENT DOCUMENTS

| | | |
|---|---|---|
| 8711344 | 8/1987 | Fed. Rep. of Germany . |
| WO93/00270 | 1/1993 | PCT Int'l Appl. . |

OTHER PUBLICATIONS

PCT International Search Report.

*Primary Examiner*—Allan N. Shoap
*Assistant Examiner*—Vanessa Caretto
*Attorney, Agent, or Firm*—Dressler, Goldsmith, Shore, Sutker & Milnamow, Ltd.

[57] ABSTRACT

A tamper-indicating plastic closure includes an annular pilfer band which is partially detachably connected to the skirt portion of the closure, whereby the pilfer band remains connected to the closure after closure removal from an associate container. The pilfer band includes a fracturable region which fractures during closure removal, whereby the pilfer band splits and separates. The fracturable region is defined by a pair of circumferentially and vertically spaced, staggered scores which are configured to facilitate high-speed manufacture, and consistent tamper-indication.

9 Claims, 1 Drawing Sheet

TAMPER-INDICATING PLASTIC CLOSURE WITH PILFER BAND HAVING STAGGERED SCORES

TECHNICAL FIELD

The present invention relates generally to a tamper-indicating plastic closure for use with an associated container, and more particularly to a tamper-indicating plastic closure having a partially detached pilfer band configured to fracture by the provision of a pair of circumferentially and vertically spaced, staggered scores.

BACKGROUND OF THE INVENTION

Tamper-indicating plastic closures have found widespread acceptance in the marketplace for use on containers for beverages and food products, as well as for non-food items. One particularly commercially successful construction is disclosed in commonly-assigned U.S. Pat. No. 4,418,828, to Wilde et. The closure of this patent can be efficiently formed in accordance with the teachings of U.S. Pat. No. 4,497,765, to Wilde et al., with a modified form of this tamper-indicating closure disclosed in U.S. Pat. No. 5,004,112, to McBride.

Notably, another particularly effective tamper-indicating plastic closure is disclosed in commonly-assigned U.S. Pat. Nos. 4,938,370, to McBride, and No. 4,978,017, to McBride.

A tamper-indicating plastic closure embodying the teachings of the above patents includes an upper closure cap, and an annular pilfer band depending from the skirt portion of the closure cap. The pilfer band is either partially or completely detachably connected to the skirt portion by a series of circumferentially spaced frangible bridges. For those applications where it is desired that the pilfer band be completely detached from the closure cap during closure removal, the closure typically functions such as that the annular band portion remains on the neck of the container. In contrast, for some applications (particularly in the case of returnable and reusable containers), it is desirable that the pilfer band only be partially detached from the closure cap attendant to closure removal, with the pilfer band remaining joined to the skirt portion of the cap. Use in this manner desirably avoids the need to remove the annular band from the container for its reuse.

When it is desired that the pilfer band remain connected to the closure cap after closure removal, closures of the type disclosed in the above-referenced patents include two particular features. First, the closure is provided with a connector portion which joins the pilfer band to the closure cap after the frangible bridges fracture during closure removal so that the pilfer band is otherwise detached from the closure cap. Additionally, such closures include a fracturable region in the annular pilfer band itself. By this construction, closure removal not only results in the desired, readily visually discernable, partial separation of the pilfer band from the closure cap, but further results in splitting or fracture of the band itself.

Commonly-assigned U.S. Pat. Nos. 4,666,053, to Corcoran et al., and No. 4,720,018, to Schetzsle et al., both hereby incorporated by reference, illustrate arrangements for providing a fracturable region in the pilfer band of a plastic tamper-indicating closure.

The present invention contemplates an arrangement for providing at least one fracturable region in the pilfer band of a plastic closure of the above-discussed type, with the present invention facilitating high-speed manufacture and reliable tamper-indication, while avoiding unintended premature fracture during manufacture, shipment, storage, or high-speed application to containers.

SUMMARY OF THE INVENTION

A tamper-indicating plastic closure embodying the principles of the present invention includes a generally annular pilfer band which is configured for partial separation during closure removal. To this end, the pilfer band includes at least one fracturable region defined by a pair of circumferentially and spaced, staggered scores. By this arrangement, high-speed closure manufacture is facilitated, while premature fracture is desirably avoided. The present scoring arrangement is particularly versatile in application and is suited for use with plastic closures having various types of container-engaging pilfer bands. By appropriately configuring the scoring arrangement, the strength exhibited by the construction, and thus the force required for its fracture, can be selected for optimum and efficient tamper-indication.

In accordance with the illustrated embodiment, the present tamper-indicating plastic closure includes a closure cap having a top wall portion, and an annular skirt portion depending from the top wall portion. The skirt portion includes an internal thread formation configured for engagement with a like thread formation on an associated container.

The closure further includes an annular pilfer band detachably connected to the skirt portion by a plurality of circumferentially spaced frangible bridges. The pilfer band includes an annular band portion, inwardly from which extend a plurality of circumferentially spaced projections configured for cooperation with an annular locking ring on the neck of the associated container. The projections cooperate with the container locking ring during closure removal to fracture and break the frangible bridges, thereby partially detaching the pilfer band from the skirt portion of the closure. In the preferred form, the frangible connection between the pilfer band and the skirt portion is provided by disposition of the frangible bridges on the inside surfaces of the skirt portion of the pilfer band, with the skirt portion and the pilfer band separated and distinguished from each other by a circumferential score line. The score line extends through the closure, and partially into the frangible bridges, whereby each of the frangible bridges defines a fracturable, unscored "residual" portion.

The pilfer band includes a connector portion, preferably an unscored portion of the closure, which integrally connects the pilfer band to the skirt portion of the closure after fracture of the frangible bridges. The connector portion permits the pilfer band to be removed from the container together with the closure cap.

In accordance with the present invention, the pilfer band includes at least one fracturable region that fractures upon removal of the closure from the container and fracture of the frangible bridges. The fracturable region is defined by a pair of spaced apart, vertically extending scores formed in the annular band portion of the pilfer band. The staggered scores can be arranged to extend vertically and parallel to the vertical axis of the closure, or can be angularly disposed.

The pair of scores are arranged in staggered relationship, i.e., are circumferentially and vertically spaced from each other. In this regard, one of the vertical scores extends downwardly from the circumferential score line between the pilfer band and the closure skirt portion, while the other one of the vertical scores extends upwardly from a lower free edge of the annular band portion of the pilfer band.

The vertically extending scores are preferably circumferentially spaced from each other by a distance less than the distance between adjacent ones of the container-engaging projections of the closure pilfer band. In the illustrated embodiment, the vertically extending scores are arranged in overlapping relationship, with the lowermost extent of one of the scores extending lower than the uppermost extent of the other one of the scores. However, the scores can be configured in non-overlapping relationship with each other.

Other features and advantages of the present invention will become readily apparent from the following detailed description, the accompanying drawings, and the appended claims.

DETAILED DESCRIPTION

Figure 1:
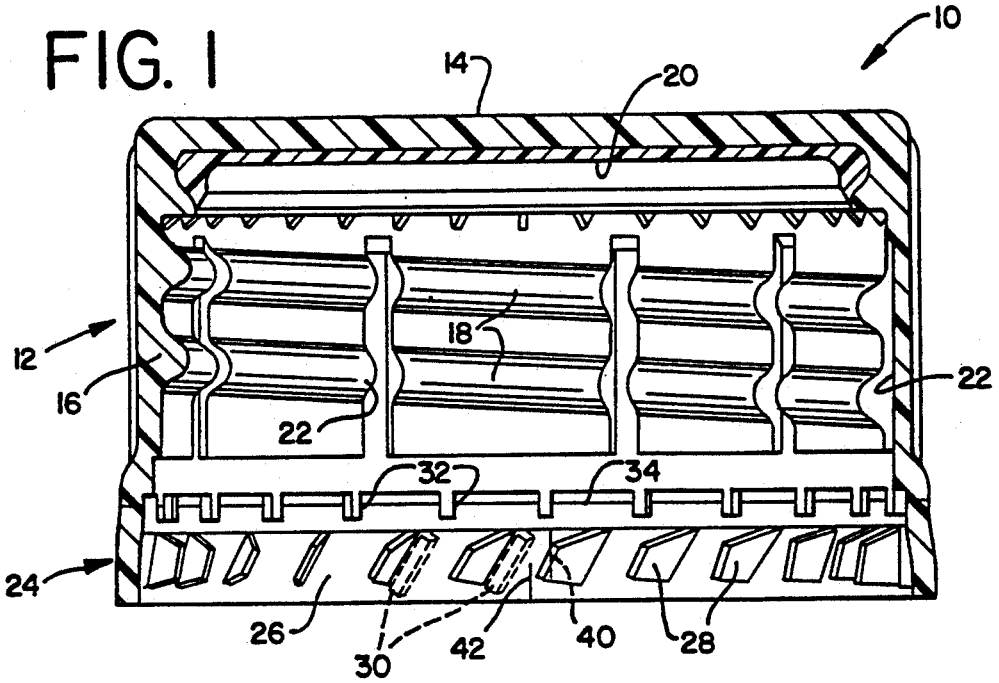
FIG. 1 is a cross-sectional view of a tamper-indicating plastic closure embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

With reference to FIG. 1, therein is illustrated a tamper-indicating closure 10 embodying the principles of the present invention. The closure 10 is illustrated in a configuration particularly suited for use on threaded containers, and more particularly, containers having carbonated or otherwise pressurized contents. Closures of this nature can be efficiently formed in accordance with the teachings of U.S. Pat. No. 4,497,765, hereby incorporated by reference.

Figure 3:
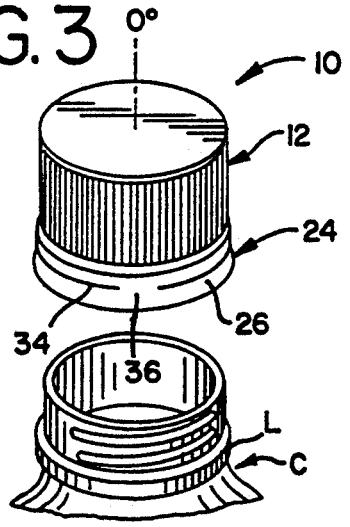
FIG. 3 is a perspective view similar to FIG. 2 showing a diametrically opposed side of the closure.

Closure 10 includes an upper, generally cup-shaped closure cap 12 including a top wall portion 14, and an annular skirt portion 16 depending from the top wall portion. The skirt portion 16 includes an internal thread formation 18 configured for removable, threaded engagement with a like thread formation on an associated container C having an annular container locking ring L (FIG. 3).

In order to enhance the sealing engagement of the closure with an associated container, the illustrated embodiment includes a generally disc-shaped sealing liner 20, which in the illustrated embodiment is configured for forming the top/side seal of an associated container. When used on a container having carbonated contents, it is preferred that the closure be provided with a plurality of generally axially extending vent grooves 22, which traverse the thread formation 18. The vent grooves facilitate the flow of gas pressure from a container during closure removal after liner 20 moves out of sealing engagement with the container, but prior to disengagement of thread formation 18 from the container.

In order to provide visually discernable evidence that the closure has been partially or completely removed, closure 10 includes an annular pilfer band 24 depending from skirt portion 16. Pilfer band 24 can be configured in accordance with the teachings of U.S. Pat. No. 4,418,828, hereby incorporated by reference, and accordingly, includes a generally annular band portion 26 inwardly from which extend a plurality of circumferentially spaced flexible projections 28. Flexible projections 28 each include an edge portion integral with annular band portion 26, which edge portion is disposed at an acute angle relative to the vertical axis of the closure. The projections 28 are configured for interfering engagement and cooperation with the annular locking ring portion of a conventionally configured container.

If desired, pilfer band 24 may be provided with a plurality of backing beads 30, two of which are illustrated in phantom line in FIG. 1, which backing beads are respectively associated with flexible projections 28. The flexible projections 28, and the optional backing beads 30, can be configured in accordance with the teachings of U.S. Pat. No. 5,004,112, hereby incorporated by reference. The projections and backing beads cooperate to promote engagement between the projections and the associated locking ring when each projection is bent generally downwardly and into engagement with the respective one of the backing beads.

As will be appreciated, the tamper-indicating closure embodying the principles of the present invention may be configured for tamper-indication by including a container-engaging arrangement other than the projections 28. For example, the pilfer band can be configured in accordance with the teachings of U.S. Pat. Nos. 4,938,370, and 4,978,017, hereby incorporated by reference.

In accordance with the present invention, pilfer band 24 is configured for partial detachment from the skirt portion of the closure cap 12, with the pilfer band remaining joined to the closure skirt after such partial detachment. To this end, the closure includes a plurality of circumferentially space frangible bridges 32 which extend between the inside surfaces of the skirt portion 16 and the annular band portion 26 of the pilfer band 24. The desired frangible connection between the pilfer band and the skirt portion is further provided by a circumferentially extending score line 34 which extends substantially, but preferably not completely, about the circumference of closure 10. The score line 34 extends through the closure to thereby separate and distinguish the pilfer band 24 from the skirt portion, with the score line extending into the frangible ribs 32 whereby each of the frangible ribs includes an unscored, frangible "residual" portion. Thus, the detachable connection between the pilfer band and the skirt portion is collectively provided by the unscored residual portions of the frangible bridges 32.

The pilfer band 24 remains joined to the skirt portion 16 of the closure cap by a connector portion 36. In accordance with the illustrated embodiment, the connector portion 36 extends between and is defined by the opposite ends of circumferential score line 34, with the connector portion 36 being provided by an unscored portion of the closure. It will be appreciated that a relatively strong, non-frangible connector portion can be otherwise provided, such as by providing one or more relatively large, non-frangible bridges on the inside surface of the closure, with complete circumferential scoring of the closure.

In accordance with the present invention, the pilfer band 24 is fracturable and detachable in a manner which results in fracture of the pilfer band itself, and partial, but not complete, separation of the pilfer band from the skirt portion of the closure. To this end, the pilfer band includes at least one fracturable region defined by a pair of vertically extending scores 40, 42. Preferably, each of the scores 40, 42 extends completely through the radial thickness of annular band portion 26.

Figure 2:
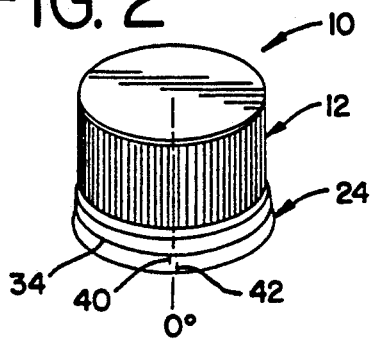
FIG. 2 is a perspective view of the closure illustrated in FIG. 1, illustrating one side thereof.

As illustrated in FIGS. 2 and 3, wherein the 0° reference line identifies the orientation of the present closure, the fracturable region defined by the vertical scores 40, 42 can be provided in substantially diametrically opposed relationship to the non-frangible connector portion 36. Alternately, the scores 40, 42 can be positioned in the region of the connector portion 36. If more than one fracturable region is provided by the provision of two or more pairs of the scores 40, 42, the fracturable regions can be positioned in spaced relationship to each other, as well as spaced from connector portion 36. Thus, the pilfer band can fracture into two or more band segments.

If two pairs of the scores 40, 42 are provided, the pairs can be spaced apart by a distance which differs from the relative spacing of any two of the container-engaging projections, such as projections 28, of the band. This acts to avoid the respective positioning of both of the fracturable regions at two different ones of the projections, thus assuring fracture of the pilfer band.

Figure 4:
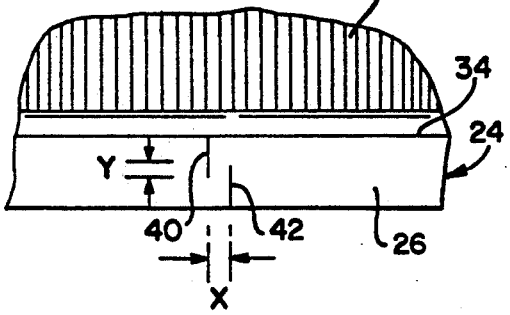
FIG. 4 is a relatively enlarged, fragmentary perspective view of the side of the closure shown in FIG. 2.

With particular reference to FIG. 4, the illustrated scores 40 and 42 are each vertically oriented, and generally parallel to the vertical axis of the closure 10. Alternately, the scores 40, 42 can be vertically extending, but angularly disposed at the same angle. Such angular disposition of the scores can be selected to correspond to the angular disposition of projections 28, such as disclosed in co-pending U.S. patent application Ser. No. 07/901,082, filed Jun. 19, 1992, hereby incorporated by reference. As illustrated, scores 40, 42 are preferably arranged in staggered relationship to each other, i.e., are circumferentially spaced and vertically spaced from each other. As will be observed, one of the vertically extending scores, i.e., score 40, extends downwardly from the circumferential score line 34, while the other one of the scores, i.e., score 42, extends upwardly from a lower free edge of the annular band portion 26 of the pilfer band 24.

In the illustrated embodiment, the vertically extending scores 40, 42 are circumferentially spaced a distance "x" from each other. Additionally, the scores can be arranged in overlapping relationship, such that the lowermost extent of one of the scores, (i.e., score 40) extends lower than the uppermost extent of the other one of the scores (i.e., score 42). In this arrangement, the scores 40, 42 overlap by a dimension "y". However, it is within the purview of the present invention that there be no overlap between the otherwise staggered and vertically extending scores. In other words, for some embodiments, it may be desirable to provide the dimension "y" with a negative, rather than the illustrated positive value.

In a current embodiment, the score 40 has a vertical dimension of 0.131 inches, with the score 42 having a dimension of 0.090 inches. This results in an overlap dimension "y" of 0.011 inches.

Circumferential spacing dimension "x" is preferably selected to be less than the distance or spacing between adjacent ones of the flexible projections 28. In the above-described current embodiment, circumferential spacing of 0.025 inches is provided.

As will be appreciated, the fracturable region of the pilfer band is provided by the residual portion which is defined by the vertically extending scores 40, 42. Typically, the residual portion will have a cross-sectional area equal to the circumferential spacing "x" of the pair of scores 40, 42, times the thickness of the annular band portion 26 of the pilfer band. Selection of the circumferential spacing of the scores with consideration of the desired strength of the pilfer band permits consistent and reliable operation to be readily achieved. By way of example, it can be assumed that it is desirable to have the pilfer band fracture under 3 pounds of force. Assuming the yield strength of the polypropylene typically used for closure manufacture to be on the order of 4,000 pounds/inches$^2$, with the cross-section thickness of the band portion 26 being 0.030 inches, the dimension "x" can be calculated as $$x = \frac{3 \text{ pounds}}{4000 \frac{\text{pounds}}{\text{inches}^2} \times 0.030 \text{ inches}} = 0.025 \text{ inches}$$

Thus, the relative circumferential spacing of the vertically extending scores can be selected to provide the desired degree of resistance to fracture. High-speed application of closures to containers is facilitated, while avoiding premature fracture. At the same time, convenient use by consumers is facilitated. Additionally, it is believed that the notch-like opening formed at the free edge of the closure by the lower one of the scores (i.e., score 42) permits the opening or "mouth" of the closure to slightly expand or open during high-speed application, thus promoting such application.

Figure 5:
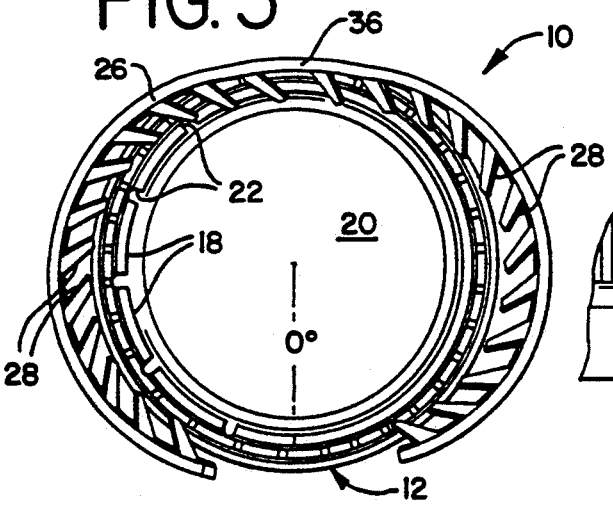
FIG. 5 is a bottom plan view of the present closure, showing a pilfer band thereof in a partially detached condition.

FIG. 5 illustrates the present closure after fracture of frangible bridges 32 and fracture of the region defined by scores 40, 42, with the pilfer band thus partially detached from the closure cap 12. As shown, the pilfer band splits into two segments respectively extending from the connector portion 36, with each segment preferably extending 120° or more about the circumference of the closure.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A tamper-indicating plastic closure for a container having an annular container locking ring, comprising:

a closure cap having a top wall portion, and an annular skirt portion depending from said top wall portion; and an annular pilfer band and frangible bridge means for partially detachably connecting said pilfer band to said skirt portion, said pilfer band including means engageable with said container locking ring during removal of said closure from said container for fracturing said frangible bridge means, said pilfer band further including a connector portion connecting said pilfer band to said skirt portion after fracture of said frangible bridge means, said pilfer band having an axial length and including at least one fracturable means that fractures upon removal of said closure from said container and fracture of said frangible bridge means, said fracturable means comprising a fracturable residual portion extending between a pair of circumferentially spaced and substantially axially offset scores formed in said pilfer band each extending only partially along the axial length of said band, so that fracture of said residual portion results in splitting of said pilfer band during closure removal.

2. A tamper-indicating plastic closure in accordance with claim 1, wherein each of said scores is generally parallel to a vertical axis of said closure.

3. A tamper-indicating plastic closure in accordance with claim 1, wherein said pair of scores are arranged in overlapping relationship, with a lowermost extent of one of the scores extending lower than an uppermost extent of the other one of said scores.

4. A tamper-indicating plastic closure in accordance with claim 1, wherein said means engageable with said container locking ring comprises a plurality of circumferentially spaced, inwardly extending projections extending inwardly from an annular band portion of said pilfer band, said pair of scores being circumferentially spaced from each other by a distance less than a distance between adjacent ones of said projections.

5. A tamper-indicating plastic closure in accordance with claim 1, wherein said fracturable means of said pilfer band is substantially diametrically opposed to said connector portion.

6. A tamper-indicating plastic closure for a container having an annular locking ring, comprising:

a closure cap having a topwall portion, and a depending annular skirt portion depending from said topwall portion and including an internal thread formation for engagement with a like thread formation of said container; and an annular pilfer band distinguished from said skirt portion by a circumferentially extending score line, and partially detachably connected to said skirt portion by a plurality of circumferentially spaced frangible bridges, said pilfer band including an annular band portion, and a plurality of circumferentially spaced projections extending inwardly from said annular band portion, said projections being engageable with said container locking ring during removal of said closure from said container for fracturing said frangible bridges, said pilfer band including a connector portion connecting said pilfer band to said skirt portion after fracture of said frangible bridges, said pilfer band having an axial length and including at least one fracturable means that fractures upon removal of said closure from said container and fracture of said frangible bridge means, said fracturable means comprising a fracturable residual portion extending between a pair of circumferentially spaced and substantially axially offset scores each extending only partially along the axial length of the band, one of which extends downwardly from said score line and the other of which extends upwardly from a lower free edge of said annular band portion of said pilfer band so that fracture of said residual portion results in splitting of said pilfer band during closure removal.

7. A tamper-indicating plastic closure in accordance with claim 6, wherein said fracturable means is substantially diametrically opposed to said connector portion.

8. A tamper-indicating plastic closure in accordance with claim 7, wherein said fracturable means has a cross-sectional area equal to a circumferential spacing of said pair of vertical scores, times a thickness of said annular band portion of said pilfer band.

9. A tamper-indicating plastic closure in accordance with claim 6, wherein said pair of scores are circumferentially spaced from each other by a distance less than a distance between adjacent ones of said projections.

* * * * *